US005992660A

United States Patent [19]

Miura et al.

[11] Patent Number: 5,992,660

[45] Date of Patent: Nov. 30, 1999

[54] CLOSURE FOR VIAL CONTAINER

[75] Inventors: Hideo Miura, Chiba; Kenji Araki, Kawasaki; Ikuo Araki, Yokohama, all of Japan

[73] Assignee: Taisei Kako Company, Limited, Osaka, Japan

[21] Appl. No.: 08/950,770

[22] Filed: Oct. 15, 1997

[51] Int. Cl.[6] ..... B65D 51/22; B65D 43/10

[52] U.S. Cl. ..... 215/247; 215/307; 215/321

[58] Field of Search ..... 215/247–249, 215/317, 321, 323, 349, 350, 274, 307; 220/319; 604/256, 403

[56] References Cited

U.S. PATENT DOCUMENTS

| | | | |
|---|---|---|---|
| 819,235 | 5/1906 | Lorenz | 215/317 |
| 1,316,231 | 9/1919 | Hammer | 215/317 |
| 3,715,063 | 2/1973 | Suski et al. | 215/321 X |
| 4,260,067 | 4/1981 | Andruchiw | 215/317 X |
| 4,515,752 | 5/1985 | Miramanda | 215/307 X |
| 4,779,750 | 10/1988 | Armstron | 215/307 X |
| 5,031,787 | 7/1991 | Ochs | 215/350 X |
| 5,125,921 | 6/1992 | Duschek | 215/247 X |
| 5,269,429 | 12/1993 | Schumacher | 215/249 |
| 5,314,084 | 5/1994 | Folta et al. | 215/321 X |
| 5,443,853 | 8/1995 | Hayes | 215/321 X |

FOREIGN PATENT DOCUMENTS

| | | | |
|---|---|---|---|
| 639892 | 4/1962 | Canada | 604/403 |
| 324573 | 7/1989 | European Pat. Off. | 215/317 |
| 7165252 | 6/1995 | Japan . | |
| 278403 | 11/1964 | Netherlands | 215/320 |

*Primary Examiner*—Stephen P. Garbe
*Attorney, Agent, or Firm*—Browdy and Neimark

[57] ABSTRACT

An improvement in a unit closure for a vial container, which helps ensure the smooth depression of the unit closure with a relatively small force from the air-expelling posture to the hermetically sealing posture and eliminate a fear of destroying the unit closure and container in depressing the protector whereby hermetic sealing and tamperproof are achieved. To this end, the locking means is of flexible locking tongues arranged such that they are inclined diametrally inwardly of the skirt and upwardly towards the ceiling of the protector, whereby, upon depressing the unit closure to its hermetically sealing posture, the locking tongues deflect radially outward of the skirt and, on completion of the depression of the unit closure, the locking tongues snap resiliently into place underneath a flange of the mouth of the container to hold firmly the unit closure in the hermetically sealing posture.

2 Claims, 14 Drawing Sheets

CLOSURE FOR VIAL CONTAINER

BACKGROUND OF THE INVENTION

1. Technical Field

The present invention relates to an improvement of a closure for a vial container.

2. Prior Art

Conventional vial containers generally have the following construction. As shown in FIG. 16, a breaking portion 3 encompassed by easily breakable lines 2, such as scores, is formed on the upper surface of a protector 1 made of an aluminum material, an engagement protrusion 5 formed on the inner surface of a synthetic resin cover (hereinafter referred to as a flip-off cap) 4 is fixed to this breaking portion 3 by an eyelet structure, a rubber stopper 6 having a vent slot 7 therein is fitted to a stopper portion 6*a* inside the protector 1, a drug inside a vial bottle 8 is freeze-dried in such a posture that the rubber stopper 6 is fitted to a bottle mouth 8*a* of the vial bottle 8 in a lift state, the rubber stopper 6 is fitted completely and air-tightly after freeze-drying, and the skirt portion of the protector 1 is thereafter wound and fastened by a winding machine. This vial container is used in the following way. As shown in FIG. 16, the breaking portion 3 is broken through the flip-off cap 4, the exposed upper portion of the rubber plug 6 is sterilized, a liquid such as distilled water is injected into the vial bottle 8 by piercing a needle such as a syringe so as to dissolve the freeze-dried drug, and the chemical solution is collected into the syringe for injection.

Conventional vial containers are known to have the following problems.

(a) The vial container is made of four kinds of materials, glass, aluminum, synthetic resin and rubber material which must be separated at the time of disposal requiring a great deal of time and labor.

(b) During the process in which the aluminum protector is allowed to stay inside a hopper and then put on a vial bottle through a feeder, aluminum dust is produced which might contaminate the flip-off cap.

(c) The rubber stopper can be lifted off during the transfer to the freeze-drying apparatus.

(d) Since the mouth portion of the vial bottle corresponding to the winding/fastening portion of the aluminum protector is opaque, inspection of the bottle mouth portion is difficult.

(e) When the cover is removed and the breaking portion is exposed, a torn portion of aluminum is formed around the breaking portion which can catch sanitary cotton used for sterilization, and hinder the sterilization of the exposed portion of the upper surface of the rubber stopper.

In an attempt to solve these problems, the applicant of the present invention had previously proposed the vial container shown in Japanese Patent Laid-Open No. 165252/1995. This vial container has the construction shown in FIG. 17. A synthetic resin protector 11 has an opening or a needle piercing window portion 12 closed by seal means 13 which can be easily pierced by a needle, on the top wall thereof, and vent means 17 communicating with the inside of a bottle container 20, inside a cylinder portion 11*a* thereof. A stopper 15 for sealing the gap between the inner surface of the top wall and the upper surface of a bottle mouth 20*a* is fitted into the protector 11. Engaging means 18 is disposed on the inner surface of the cylinder portion 11*a* to keep the protector 11 in a semi-stopping freeze-drying posture before freeze-drying and in a full-stopping seal posture after freeze-drying.

OBJECT AND SUMMARY OF THE INVENTION

Thus, in the vial container according to the invention, separation of the materials at the time of disposal and burning is extremely easy, lift and come-off of the protector does not occur during the transfer of the vial container for freeze-drying, and the freeze-drying efficiency is improved. However, when the posture of the protector 11 is changed from the semi-stopping freeze-drying posture to the full-stopping seal posture, a strong stopping pressure is necessary in the engaged position shown in FIG. 9. Such a strong stopping pressure might break the bottle container or the protector. If the engaging means is made weaker so as to reduce the stopping pressure, lift of the protector may occur. If so, the inside of the bottle container communicates with the external air, the degree of sealing becomes unstable, and the drug which is freeze-dried becomes unstable or becomes contaminated. Furthermore, because the protector can be removed from the outside, forgery of the drug can be expected.

It is therefore an object of the present invention to provide a vial container which can ensure a smooth shift from a semi-stopping freeze-drying posture to a full-stopping seal posture, so that the full-stopping seal posture is maintained and the container is entirely free from possible forgery of the drug by removing a protector.

The vial container according to the present invention solves the problem of the prior art technology by the following means.

The object of the invention described above can be accomplished by a vial container including a synthetic resin protector equipped at the top wall thereof with an opening or a needle piercing window portion closed by seal means capable of being easily pierced by a needle and at a cylinder portion thereof with vent means communicating with the inside of a bottle container, which protector has seal means fitted thereinto for sealing the gap between the inner surface of the top wall and a bottle mouth and engaging means disposed integrally on the inner surface of the cylinder portion of the protector for keeping a full-stopping seal posture of the protector. This is accomplished by engaging means comprising engaging plates having an upper end which are inclined inward and upward towards the protector cylinder portion and which are flexible, bendable and deformable so that the shift of the protector from a semi-stopping freeze-drying posture permits the engaging plates to smoothly engage the upper surface of the bottle mouth in a full-stopping seal posture, and the full-stopping seal posture in which the upper end of the engaging plates in the inclined posture engages with a recess of a flange portion of the bottle mouth can be firmly secured.

The object described above can be accomplished by disposing the engaging plates on the inner surface of a cylinder portion constituting the protector at suitable intervals between them, and forming the vent means described above between the engaging plates.

The object described above can be accomplished also by disposing engaging means for preventing lift of the protector and keeping the semi-stopping freeze-drying posture on the inner surface of the cylinder portion constituting the protector.

The object described above can be accomplished by a vial container including a synthetic resin protector equipped at the top wall thereof with an opening or a needle piercing window portion closed by seal means capable of being easily pierced by a needle and at a cylinder portion thereof with vent means communicating with the inside of a bottle container, which protector has seal means fitted thereinto for sealing the gap between the inner surface of the top wall and a bottle mouth and engaging means disposed integrally on the inner surface of the cylinder portion of the protector for keeping a full-stopping seal posture of the protector, wherein the engaging means comprises engaging plates the upper end of which is inclined inward and upward towards the protector cylinder portion, which is flexible, bendable and deformable to assume its original shape and the upper end of which engages with the lower side of a flange portion of the bottle mouth to thereby keep the full-stopping seal posture of the protector and an annular member having the engaging plates formed integrally with the vent means communicating with the inside of the bottle container is fitted to an engagement recess formed round the entire periphery of the inner surface of the cylinder portion of the protector.

The object described above can be accomplished by integrally forming engaging means for preventing lift of the protector and keeping the semi-stopping freeze-drying posture on the inner surface of the lower portion of the annular member.

The object described above can be accomplished by insert-molding the seal means inside the protector.

BRIEF DESCRIPTION OF THE INVENTION

DETAILED DESCRIPTION OF THE PREFERRED EMBODIMENT(S) OF THE INVENTION

Figure 1:
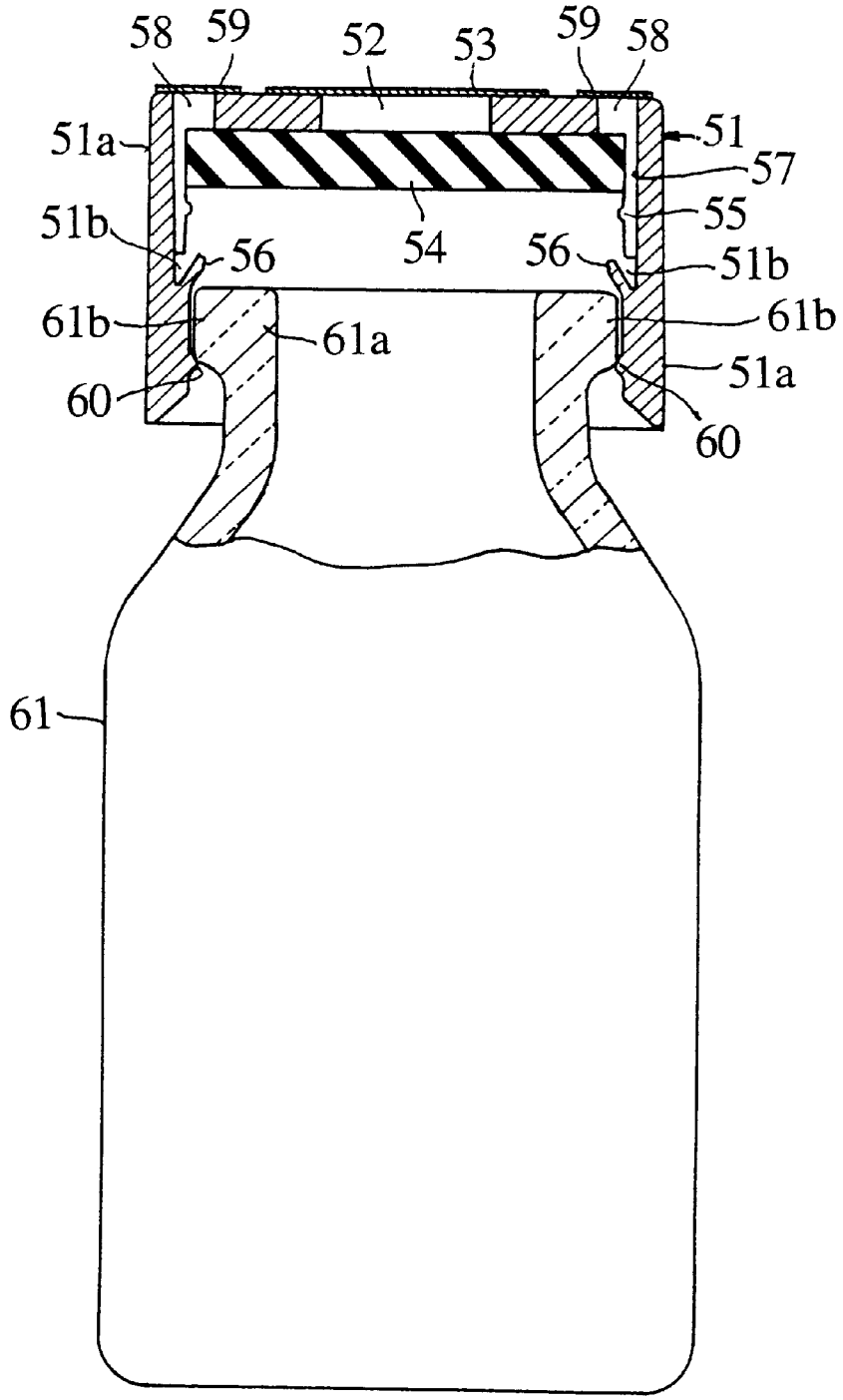
FIG. 1 is a longitudinal sectional front view of a semi-stopping freeze-drying posture.

The embodiment (1) of the present invention will be described in detail with reference to the drawings.

The detail of the first embodiment (1) will be described with reference to FIGS. 1 to 7. Reference numeral 51 denotes a protector made of a synthetic resin, and a needle piercing window portion 52 is formed at the center of the top wall of this protector 51. A seal 53 for closing the needle piercing window portion 52 is stuck to the upper surface of the top wall of the protector 51. Identification information (not shown) such as the name of the drug, the quantity of the drug, etc, is printed on the surface of this seal 53. A thin seal film through which a syringe needle can be easily pierced may be formed integrally at the needle piercing window portion 52 in place of the seal 53. A sheet-like packing 54 made of a rubber or a synthetic resin and coming into contact with the inner surface of the top wall is fitted to the inner upper part of the protector 51. The lower peripheral portion of the seal-like packing 54 is engaged with a small protrusion 55 formed integrally with the upper part of the inner surface of a cylinder portion 51 that constitutes the protector 51. Incidentally, the protrusion 55 may be omitted depending on the structure of the sheet-like packing 54.

Figure 4:
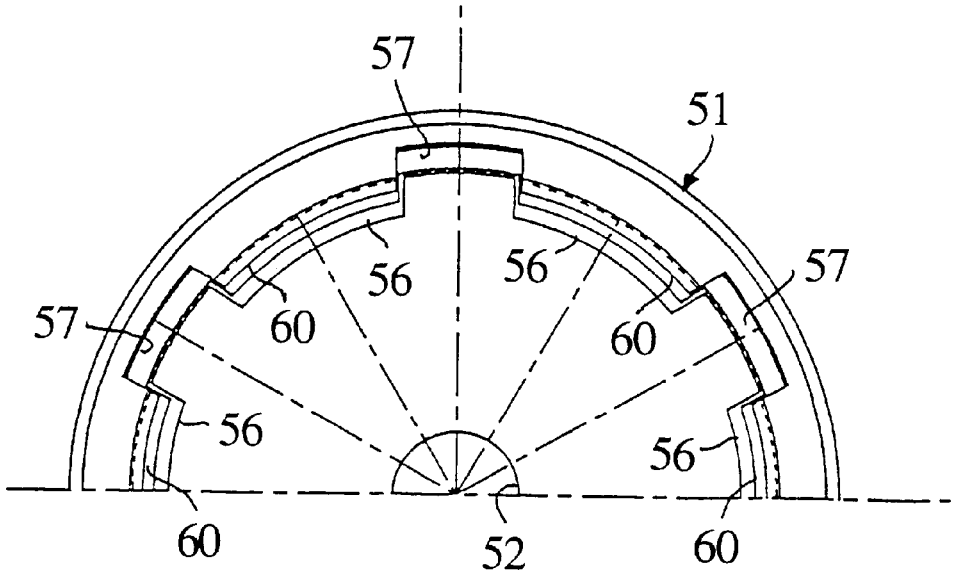
FIG. 4 is a bottom view of a part of the protector.
Figure 5:
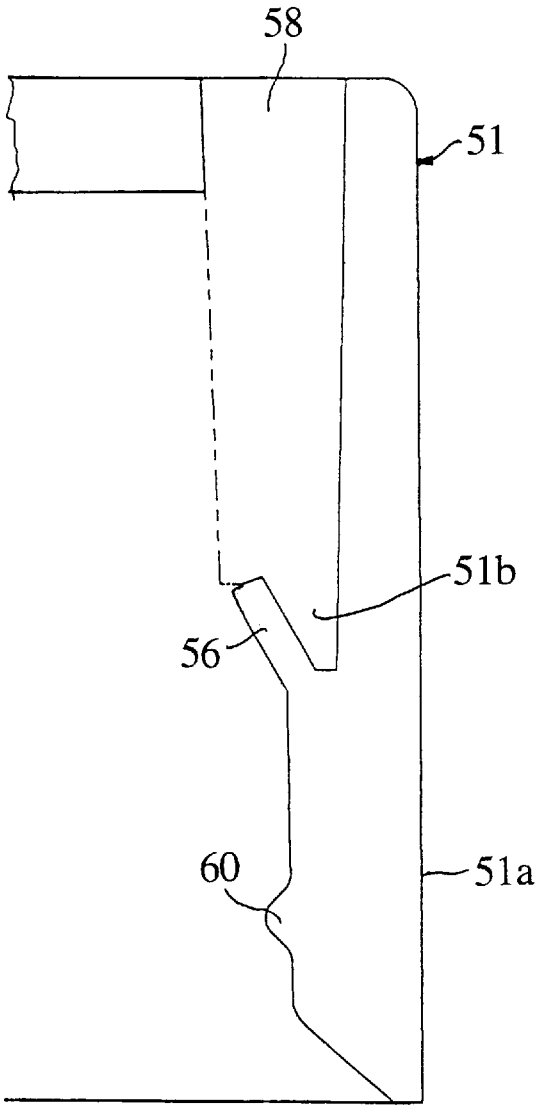
FIG. 5 is an enlarged sectional view of an engaging plate.
Figure 6:
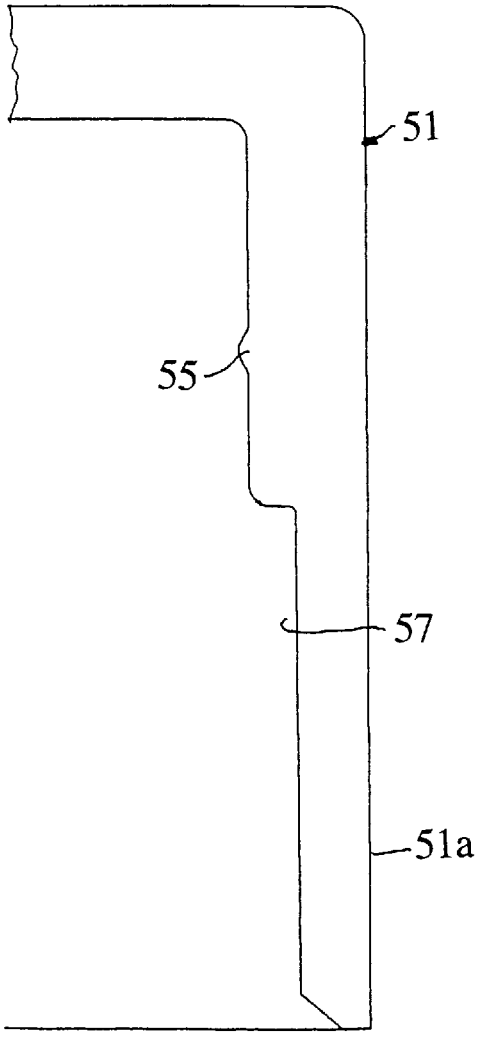
FIG. 6 is an enlarged sectional view of a vent groove portion.
Figure 7:
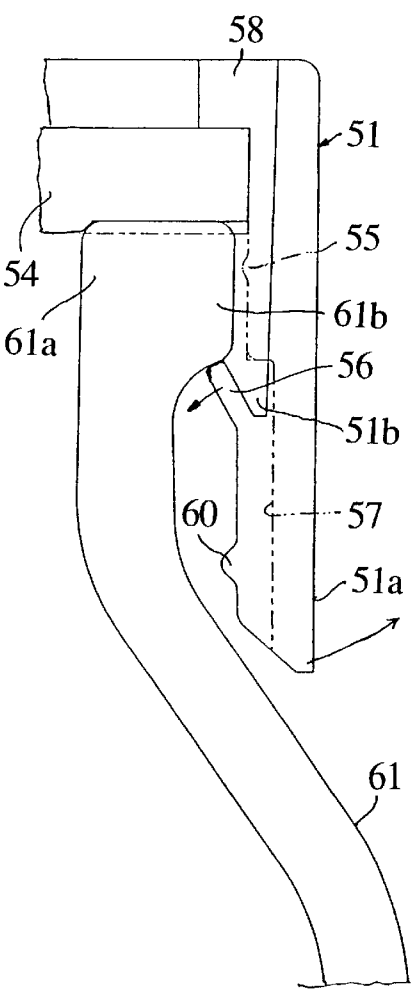
FIGS. 7*a, b* and *c* are flowcharts of the shift from a semi-stopping freeze-drying posture to a full-stopping posture.
Figure 7:
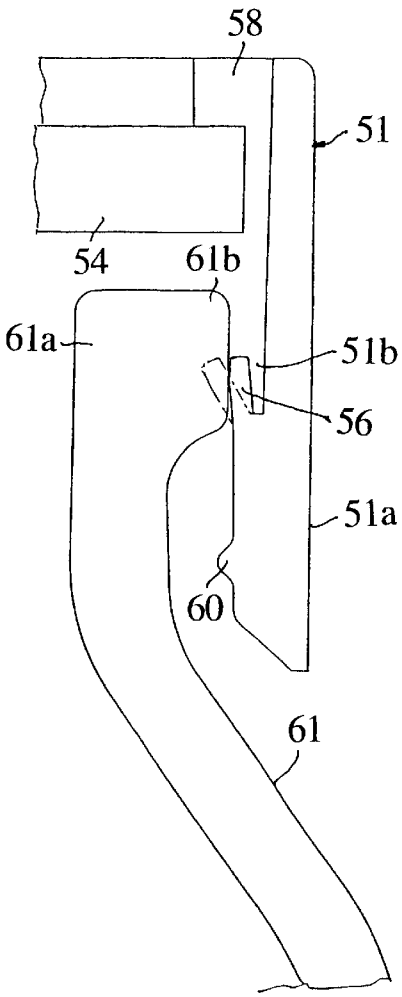
Figure 7:
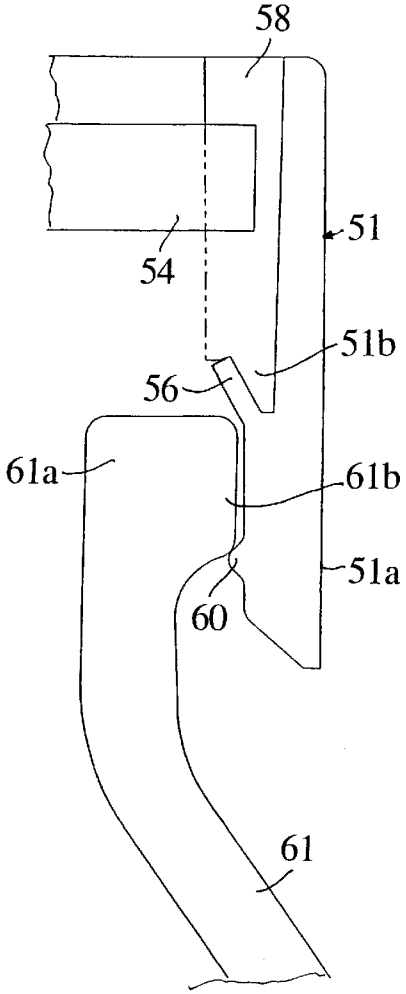

Engaging plates 56, which have flexibility, are formed interruptedly and integrally at the substantial center of the inner surface of the cylinder portion 51*a* of the protector 51. The engaging plates 56 are constituted in the following way. Each engaging plate 56 comprises a lip structure which is inclined inward and upward towards the inside of the cylinder portion 51*a*, at the substantial center of the cylinder portion 51*a* constituting the protector 51 and moreover, is deformable in the outer direction and can be fitted into a gap portion 51*b* formed on the inner surface of the cylinder portion of the protector 51. The lower proximal portion of the engaging plate 56 is integral with the cylinder portion 51*a* of the protector 51. The engaging plates 56 are formed interruptedly as described above and more concretely, with suitable gaps between them as shown in FIG. 4 in such a manner as to define a vent passage 57 by reducing the thickness of the cylinder portion 51*a* to the lower end between the engaging plates 56, as shown by imaginary lines in FIG. 6 or 7. Reference numeral 58 in the drawings denotes a draft hole of a mold used for molding the engaging plates 56. This draft hole 58 is closed by a seal 59.

In this embodiment (1), the needle piercing window portion 52 and the draft hole 58 are closed by the separate seals 53 and 59, respectively, but they can be closed by one common seal (not shown). In addition, the needle piercing window portion 52 of the protector 51 and the draft hole 58 can be closed without using the seals 53 and 59 by fitting tightly and separably a flip-off cap 4 shown in FIG. 8 to the outer surface of the top wall of the protector 51, fitting appropriately an engaging protrusion portion 5 formed on the inner surface of the flip-off cap and having an eyelet structure to the needle piercing window portion 52 of the protector 51 and then heat-treating the lower end of the engaging protrusion portion 5 so as to engage it with the inner surface of the top wall of the protector 51 and to ensure a tight fitting state of the engaging protrusion portion 5 to the protector 51. Therefore, closing means is not particularly limited to the structure shown in the drawings. When the flip-off cap 4 having such a structure is used, re-fitting of the engaging protrusion 5, which is fitted from outside the needle piercing window portion 52 of the protector 51 can be inhibited, and forgery of the inner drug can be prevented.

Protrusions 60 which are in parallel with the protrusion 55 described above are formed integrally at the lower part of the inner surface of the protector 51, and a flange portion 61*b* formed at the mouth portion 61*b* of a vial bottle 61 is clamped between the protrusions 60 and the proximal portions of the engaging plates 56 so that the protector 51 can be kept in the posture of semi-stopping freeze-drying as shown FIG. 1 and FIG. 7*a*. In this posture, freeze-drying can be effected because the inside of the vial bottle 61 is kept communicating with the external air through the vent passage 57 described above. Incidentally, the protrusions 60 may be omitted because the protector 51 can be kept in the stable semi-stopping freeze-drying posture by elongating the cylinder portion 51*a* of the protector 51, for example.

Explanation of Function

Figure 2:
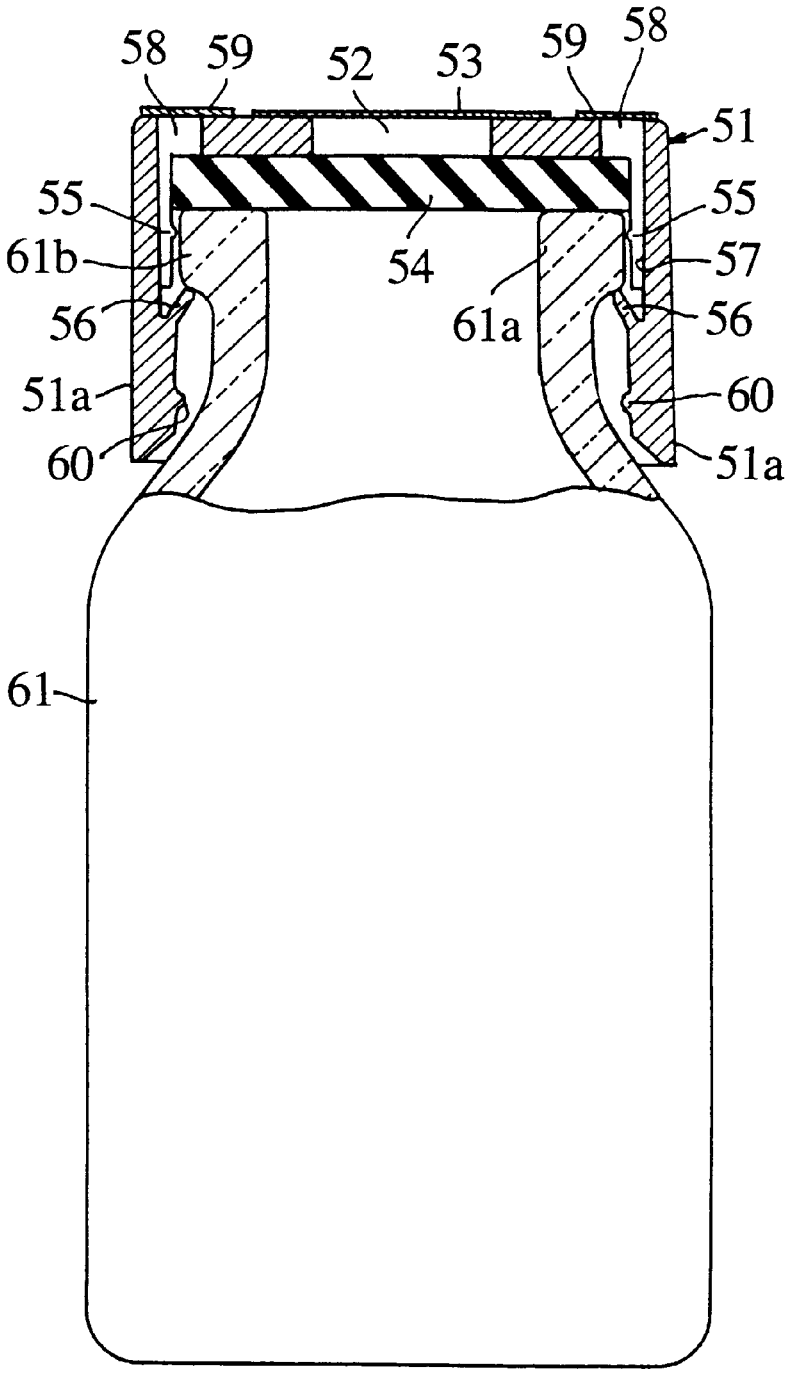
FIG. 2 is a longitudinal sectional front view of a full-stopping posture.
Figure 3:
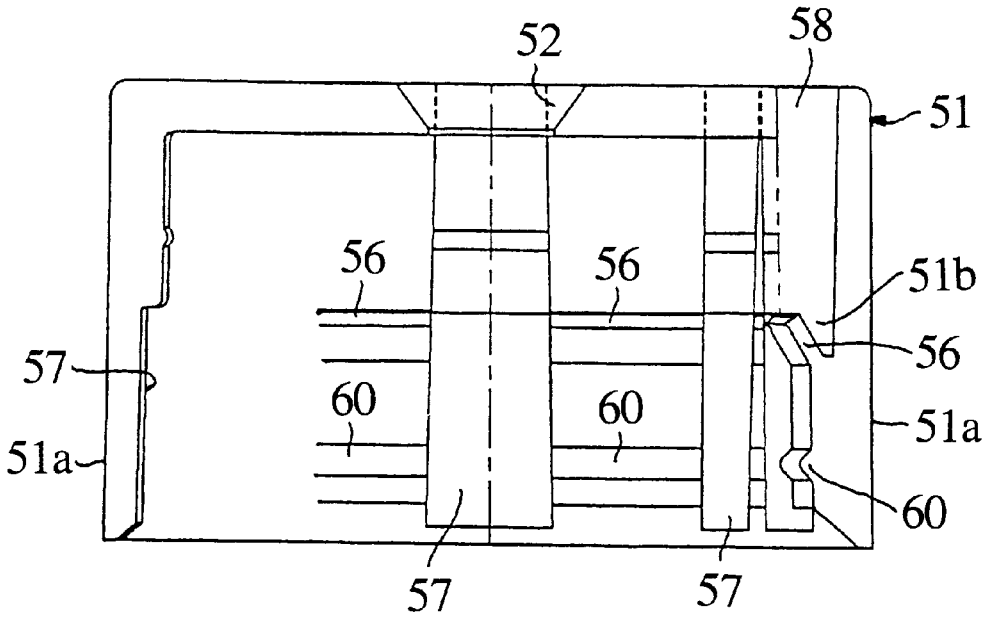
FIG. 3 is a longitudinal sectional front view of a protector.

The function of the embodiment (1) will be described. Freeze-drying of the drug stored in the vial bottle 61 is effected in the semi-stopping posture shown in FIG. 1. After freeze-drying is completed, the protector 51 is pushed down. Then, the full-stopping seal posture shown in FIG. 2 is maintained and the inside of the vial bottle 61 is shut off from the external air by the function of the seal-like packing 54. When the posture shifts from the semi-stopping freeze-drying posture to the full-stopping seal posture, the engaging plate 56 of the protector 51 which keeps contact with the flange portion 61*b* of the bottle mouth 61*a* is bent outward as shown in FIG. 7*b* and enters the gap portion 51*b*, so that the protector 51 is pushed down smoothly by a relatively small force. When the engaging plate 56 passes by the flange portion of the bottle mouth, the engaging plate 56 is released as shown in FIG. 7*c* and returns to the inward inclination state due to its flexibility, and the digital end of the engaging plate 56 engages with the lower jaw of the flange portion 61*b* of the bottle mouth. At this time, as is obvious from FIG. 7*c*, the outer periphery of the seal-like packing 54 is pushed strongly and is compressively deformed between the upper surface of the bottle mouth 61*a* and the lower part of the top wall constituting the protector 51. In consequence, a strong seal effect is produced and the reaction of the compressed portion of the seal-like packing 54 strongly pushes the distal end of the engaging plate 56 to the jaw of the flange portion 61*b* of the bottle mouth.

In FIG. 7*c*, when the protector 51 is to be removed outside by applying the force in the direction of the arrow to the skirt of the cylinder portion 51*a* of the protector 51, the turning action in the direction of the arrow is given to the engaging plate 56. This completely prevents forgery of the drug by opening accidentally and removing it from the vial container 61.

Next, the embodiment (2) of the present invention will be described with reference to FIGS. 8 to 12.

Reference numeral 71 denotes a protector made of a synthetic resin. A needle piercing window portion 72 is formed at the center of the top wall of the protector 71 and a seal 73 for closing the needle piercing window portion 72 is stuck to the upper surface of the top wall of the protector 71. Identification information (not shown) such as the name of the drug, the quantity, etc, is printed on the surface of this seal 73. Incidentally, a thin seal film through which a syringe needle can pierce easily may be formed integrally with the needle piercing window portion 72. A sheet-like packing 74 made of a rubber or a synthetic resin material and coming into contact with the inner surface of the top wall is fitted to the inner upper part of the protector 71. The peripheral lower portion of this seal-like packing 74 is engaged with small protrusions 75 formed integrally at the upper part of the inner surface of a cylinder portion 71*a* constituting the protector 71. Incidentally, the protrusions 75 may be omitted depending on the structure of the sheet-like packing 74.

An engagement recess 71*b* is formed round the entire periphery of the inner surface of the cylinder portion 71*a* of the protector 71. An annular member 76 to be fitted to the engagement recess 71*b* is formed separately from the protector 71. The thickness of this annular member 76 is greater than the depth of the engagement recess 71*b*. An engaging plate 76*a*, the upper end of which is inclined upward and inward, which can bend and return to the original posture and the upper end of which engages with the lower side of the flange portion 77*b* formed at the bottle mouth 77*a* of the vial bottle 77 and keeps the full-stopping seal posture of the protector 71, is formed integrally at the inner upper portion of the annular member 76. Reference numeral 71*c* in the drawing denotes a restraining portion of the annular member 76.

Vent grooves 76*b* having a depth t corresponding to the thickness of the annular members 76 and protruding from the engagement recess 71*b* of the protector 71 are formed in regularly annularly spaced positions of the annular member 76 in such a manner as to penetrate through the annular member 76 in the vertical direction, and the engaging plates 76*a* described above are formed between these vent grooves 76*b*. Reference numeral 76*c* in the drawing denotes an engaging protrusions which engage with the lower plate of the flange portion 77*b* of the bottle mouth and keep the semi-stopping freeze-drying posture at the time of this semi-stopping freeze-drying posture of the protector 71.

A recess portion 71*d* shallower than the engagement recess 71*b* is so formed above the engagement recess 71*b* continuously formed on the protector 71. When the engaging plate 76*a* of the annular member 76 passes by the outer peripheral portion of the bottle mouth 77*a* at the time of full-stopping of the protector 71, the engaging plate 76*a* is bent and fitted into the recess 71*d* so that the full-stopping process can be carried out smoothly.

Figure 16:
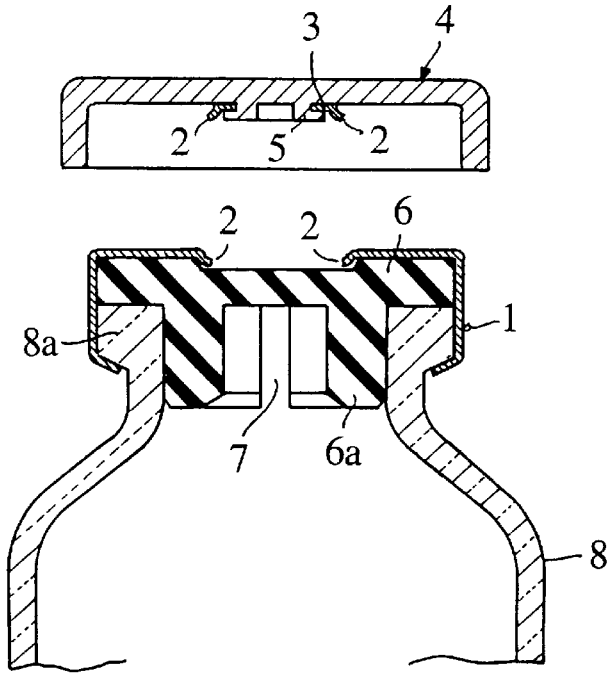
Fig. 16 Prior Art
FIG. 16 is an exploded sectional view of a prior art example.
Figure 17:
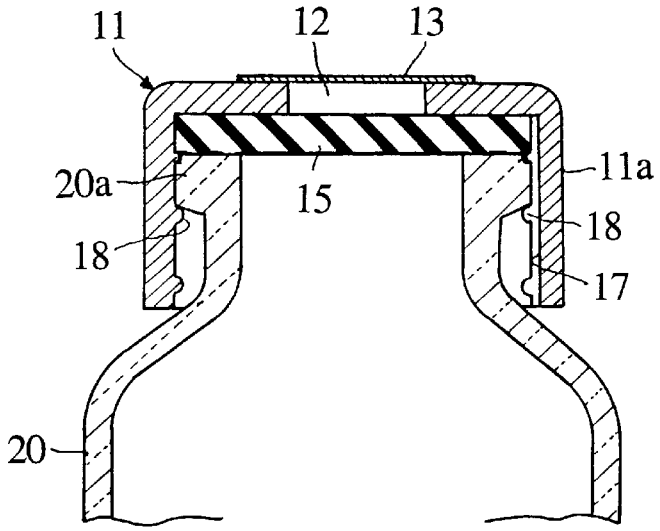
Fig. 17 Prior Art
FIG. 17 is a longitudinal sectional view of the prior art example.

A flip-off cap 4 shown in FIG. 16 is fitted removably and tightly to the outer surface of the top wall of the protector 71 in place of the seal 73, and an engaging protrusion 5 having an eyelet structure and formed on the inner surface of the flip-off cap 4 is fitted appropriately into a needle piercing window portion 72 of the protector 71. Next, the lower end of the engaging protrusion 5 is heat-treated so as to engage with the inner surface of the top wall of the protector 71. In this way, the tight fitting posture to the protector 71 can be maintained and the needle piercing window portion 72 of the protector 71 can be closed. Therefore, the closing means is not particularly limited to the structure shown in the drawing. When the flip-off cap 4 having such a structure is used, re-fitting of the engaging protrusion 5, which is once removed from the needle piercing window portion 72 of the protector 71, can be impeded, and forgery of the contained drug can be prevented.

In the embodiment (2) of the present invention described above, the annular member 76 fitted to the engagement recess 71*b* of the protector 71 is prevented from coming off by the engagement recess 71*b*, more concretely, by the restraining portion 71*c* formed integrally with the lower side of the protector 71. Since the outside wall surface of the annular member 76 may be bonded to the inside wall surface of the engagement recess 71*b* by an adhesive or high frequency induction heating, however, the structure is not particularly limited to the structure shown in the drawings. This bonding means can omit the structure of the restraining portion 71*c* and assembly of the annular member 76 to the protector 71 can be simplified.

Explanation of Function

Figure 8:
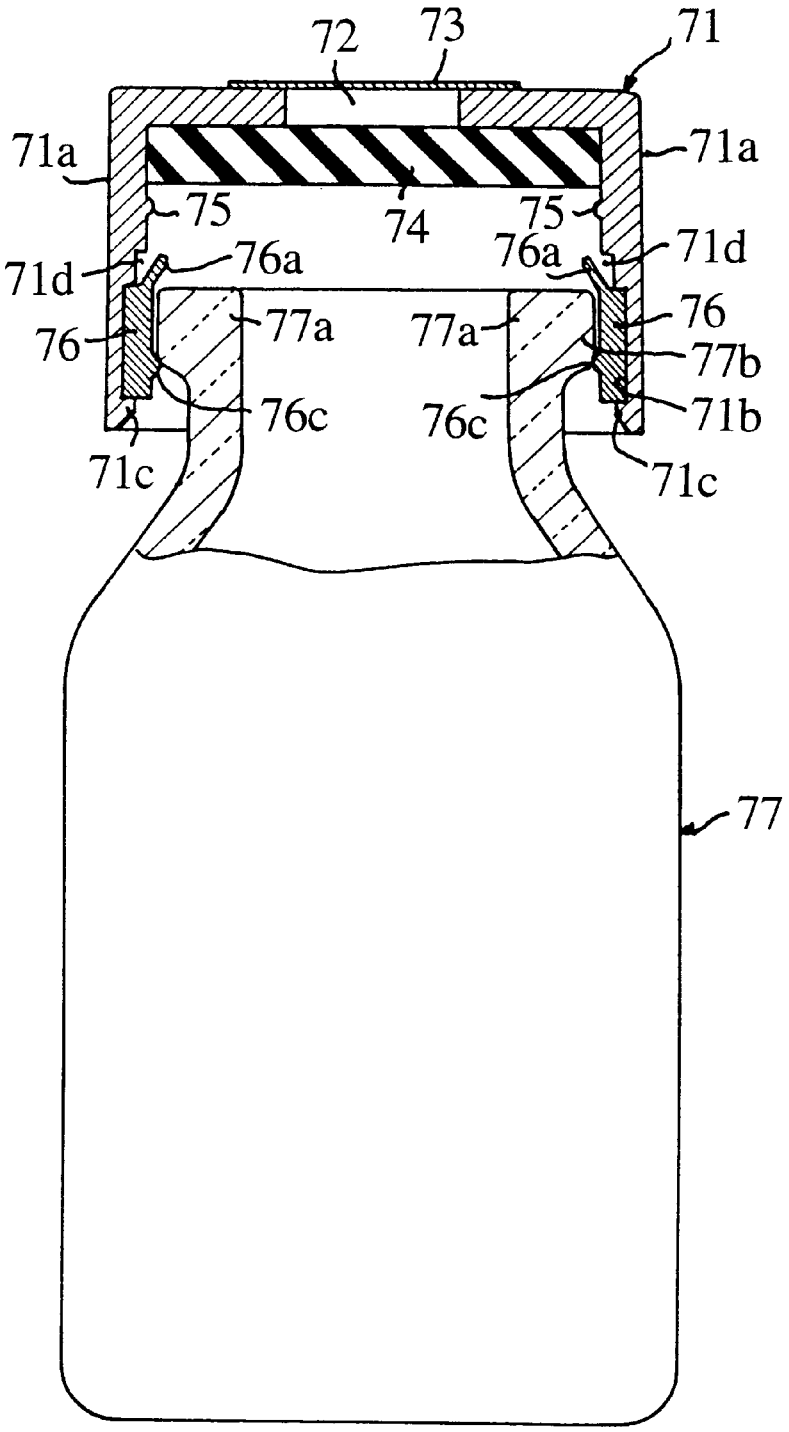
FIG. 8 is a longitudinal sectional front view of an embodiment (2) of the present invention in the semi-stopping freeze-drying posture.
Figure 9:
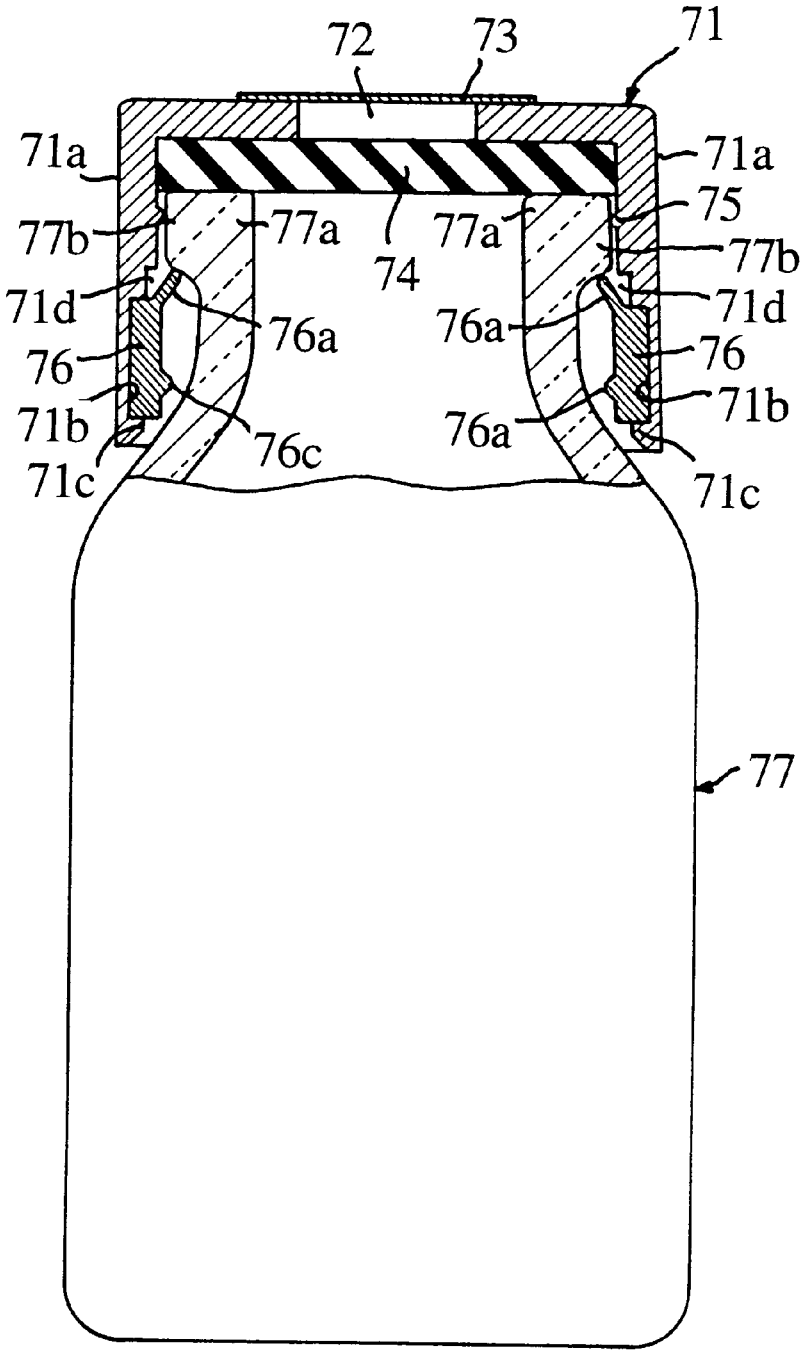
FIG. 9 is a longitudinal sectional front view of the full-stopping seal posture.
Figure 10:
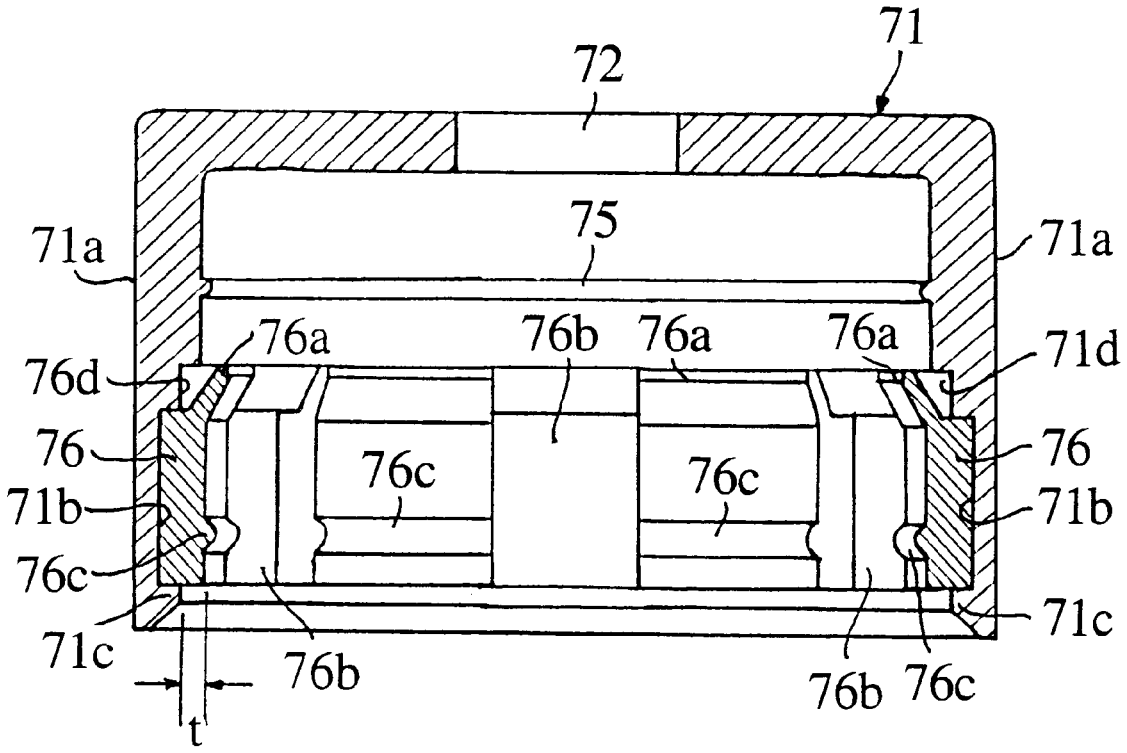
FIG. 10 is a longitudinal sectional enlarged front view of a protector.
Figure 11:
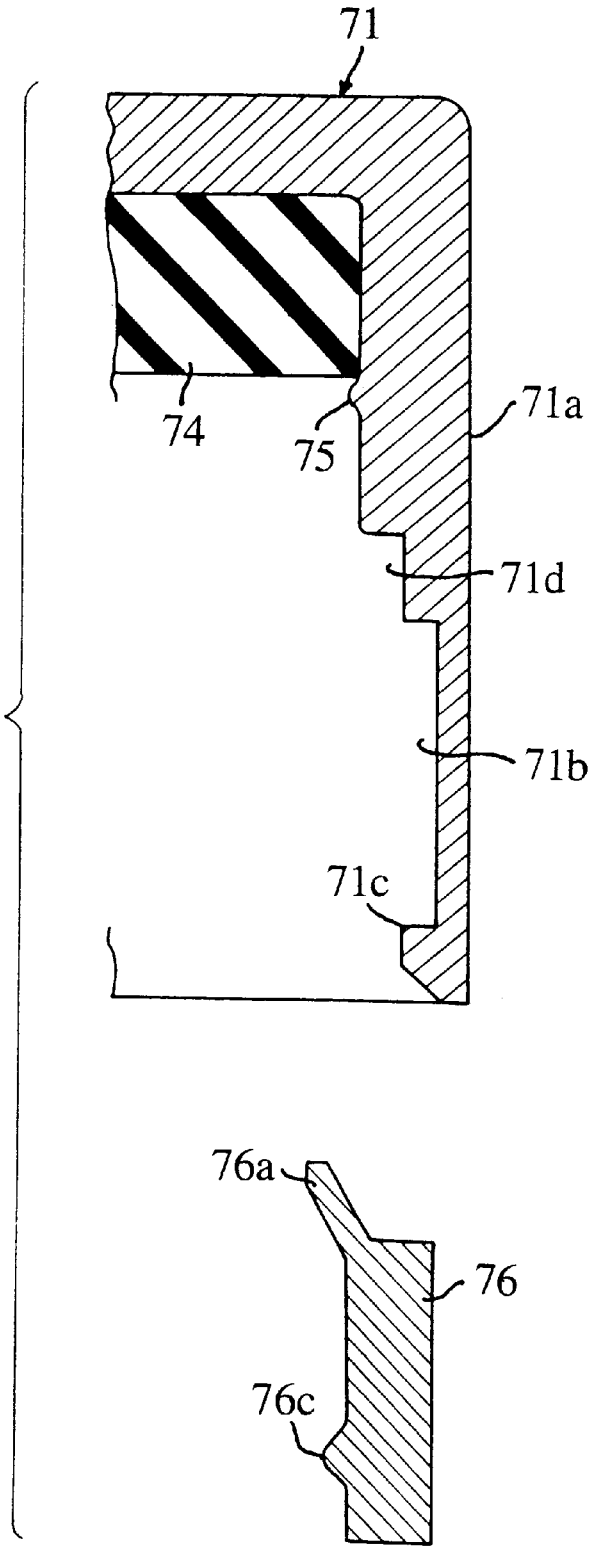
FIG. 11 is a sectional view of essential portions when the protector and an annular member are shut off.
Figure 12C:
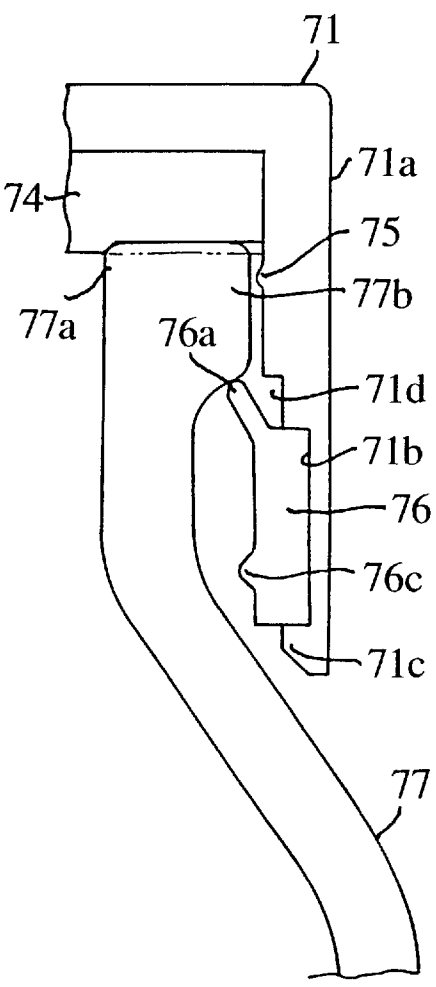
FIGS. 12*a, b* and *c* are flowcharts of the shift of the protector from the semi-stopping freeze-drying posture to the full-stopping seal posture of the protector to a vial bottle.
Figure 12B:
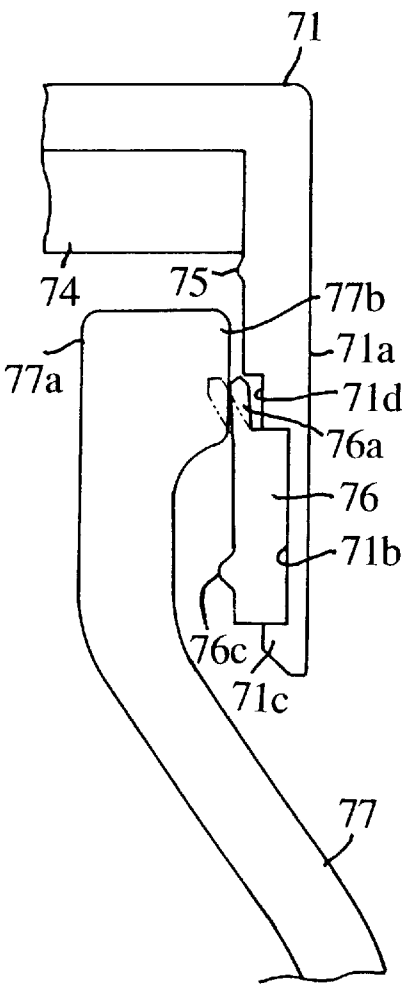
Figure 12A:
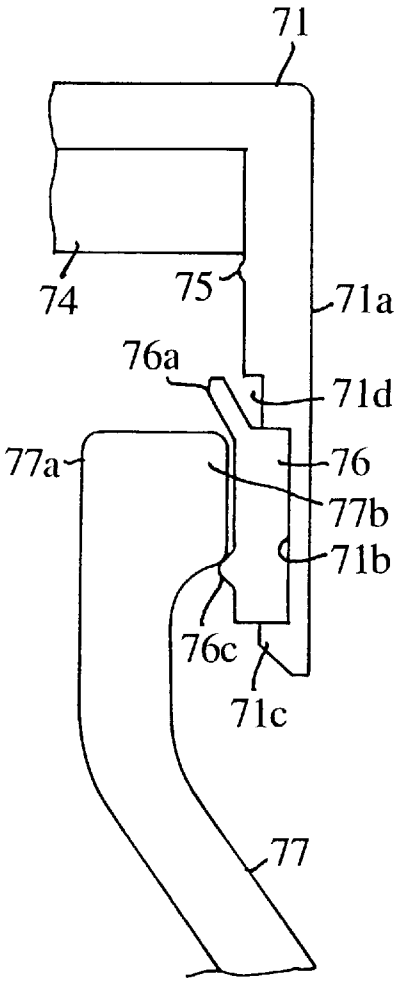

Freeze-drying of the drug contained in the vial bottle is effected in the semi-stopping posture shown in FIG. 8. After freeze-drying is completed, the protector 71 is pushed down. Then, the full-stopping seal posture shown in FIG. 9 can be maintained and the inside of the vial bottle 77 is shut off from the external air by the function of the seal-like packing 74. When the posture shifts from the semi-stopping freeze-drying posture to the full-stopping seal posture, the engaging plate 76*a* of the annular member 76 keeping contact with the bottle mouth flange portion 77*b* of the bottle mouth 77*a* shown in FIGS. 12*a, b* and *c* is bent outward and enters the recess 71*d* as shown in FIG. 12*b*, so that the protector 71 is pushed and lowered smoothly by a relatively small force. When the engaging plate 76*a* passes by the bottle mouth flange portion 77*b*, the engaging plate 76*a* is released as shown in FIG. 12*c*, returns to the inward inclination posture due to its flexibility, and the distal end of the engaging plate 76*a* engages with the lower jaw portion of the bottle mouth flange portion 77*b*. At this time, the outer periphery of the seal-like packing 74 undergoes strong compressive deformation between the upper surface of the bottle mouth 77*a* and the lower surface of the top wall constituting the protector 71 as can be clearly seen from FIG. 12*c*. As a result, a strong seal effect is produced, and the reaction of the compressed portion of the seal-like packing 74 pushes strongly the distal end of the engaging plate 76*a* to the jaw portion of the bottle mouth flange portion 77*b*.

When an attempt is made to remove the protector 71 by applying the outward force in the direction of the arrow in FIG. 12*c* to the skirt of the cylinder portion 71*a* of the protector 71, the inward turning force in the direction of the arrow is given to the engaging plate 76*a*. This completely prevents forgery of the contained drug by opening the protector 71 and removing it from the vial bottle 77.

Figure 13:
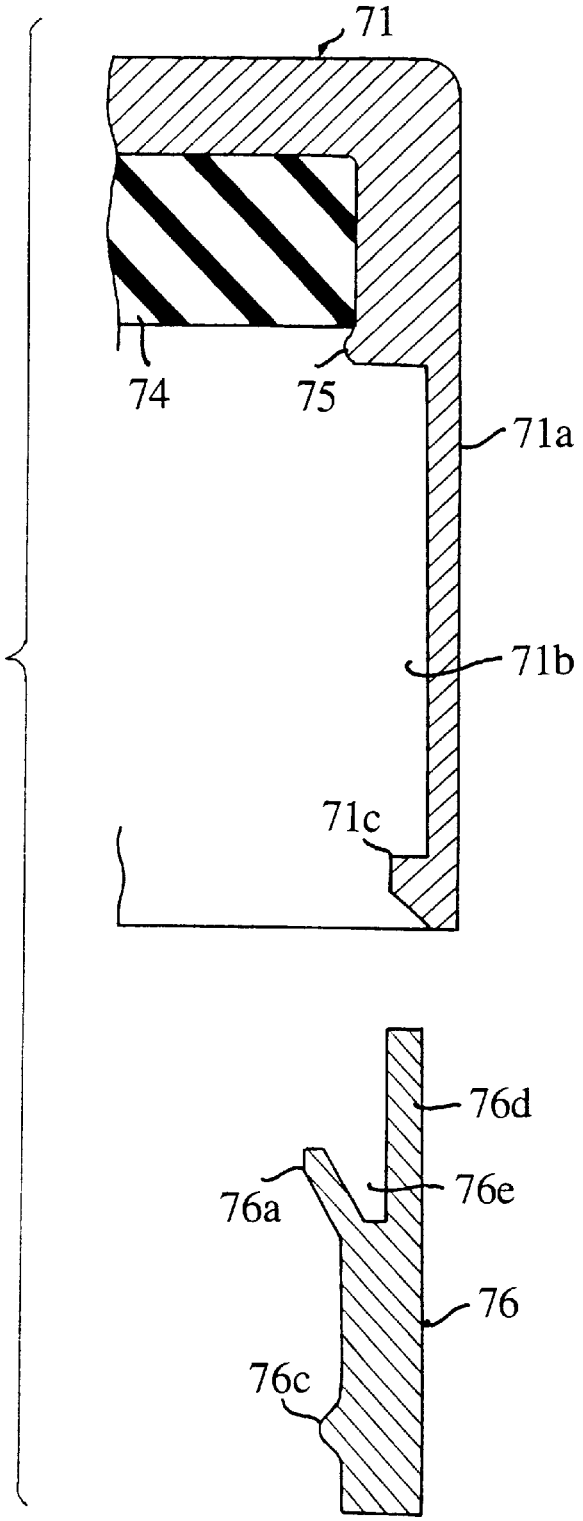
FIG. 13 is a sectional view of essential portions and shows the protector and the annular member of the embodiment (3).

Next, the embodiment (3) of the present invention will be described in detail with reference to FIG. 13.

The upper end of an engagement recess 71*b* formed on the inner surface of a cylinder portion 71*a* of a protector is extended near to the lower side of a sheet-like packing 74. An annular sheet portion 76*d* having a length corresponding to the extension length of the engagement recess 71*b* is formed integrally at the upper end of the outside portion of the annular member 76. An insertion gap 76*e* which can be bent and can flexibly return to the original shape is formed between the engaging plate 76*a* and the inside wall surface of the annular sheet portion 76*d*.

This embodiment (3) can obtain the same function as that of the embodiment (2) and because the engaging recess portion of the engagement plate 76*a* need not be formed in the protector 71, the mold for shaping the protector 71 can be simplified, and the quantity of the molding resin material can be saved, though it is limited.

Figure 14:
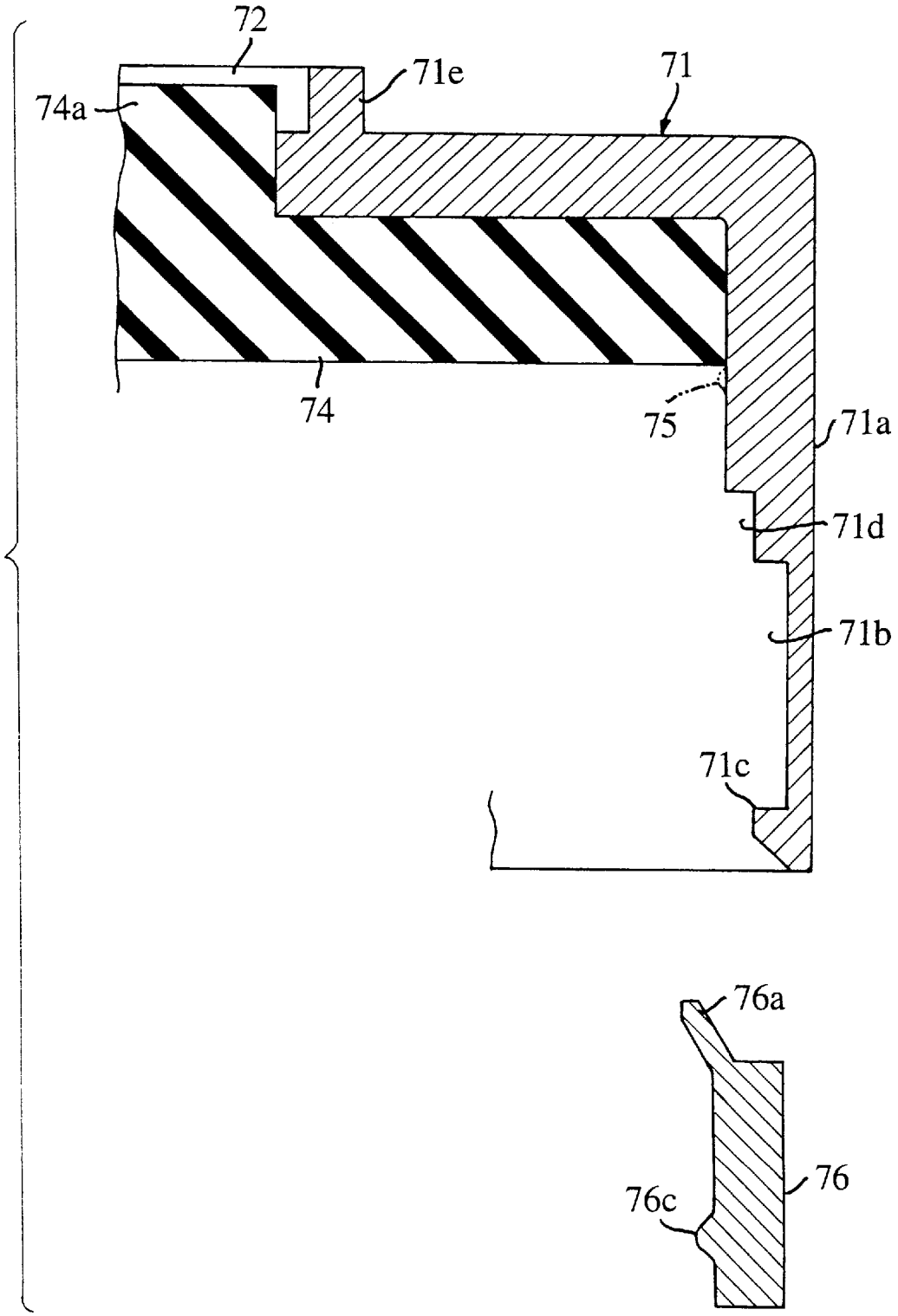
FIG. 14 is a sectional view of essential portions and shows the protector and the annular member of the embodiment (4).

The embodiment (4) of the present invention will be described in detail with reference to FIG. 14. In this embodiment, the sheet-like packing 74 is inserted when the protector 71 is molded. A round protrusion 71*a* is formed integrally at the center of the upper portion of the sheet-like packing 74 and while this round protrusion 74*a* is fitted to, and supported by, a female mold (not shown) for molding the protector 71, a male mold (not shown) is so disposed as to oppose the female mold. A resin material is then fed between both molds, and the protector 71 into which the sheet-like packing 74 is inserted is molded.

In this instance, the female mold is constituted in such a manner as to be capable of molding integrally a ring-like ridge 71*e* which is concentric with the round protrusion 74*a*, is somewhat taller than the round protrusion 74*a* and corresponds to the needle piercing window portion, on the upper surface of the protector 71 outside the round protrusion 74*a* fitted to, and supported by, the female mold. The needle piercing window portion 72 constituted by forming the ring-like ridge 71*e* can be closed by a seal (not shown).

Figure 15:
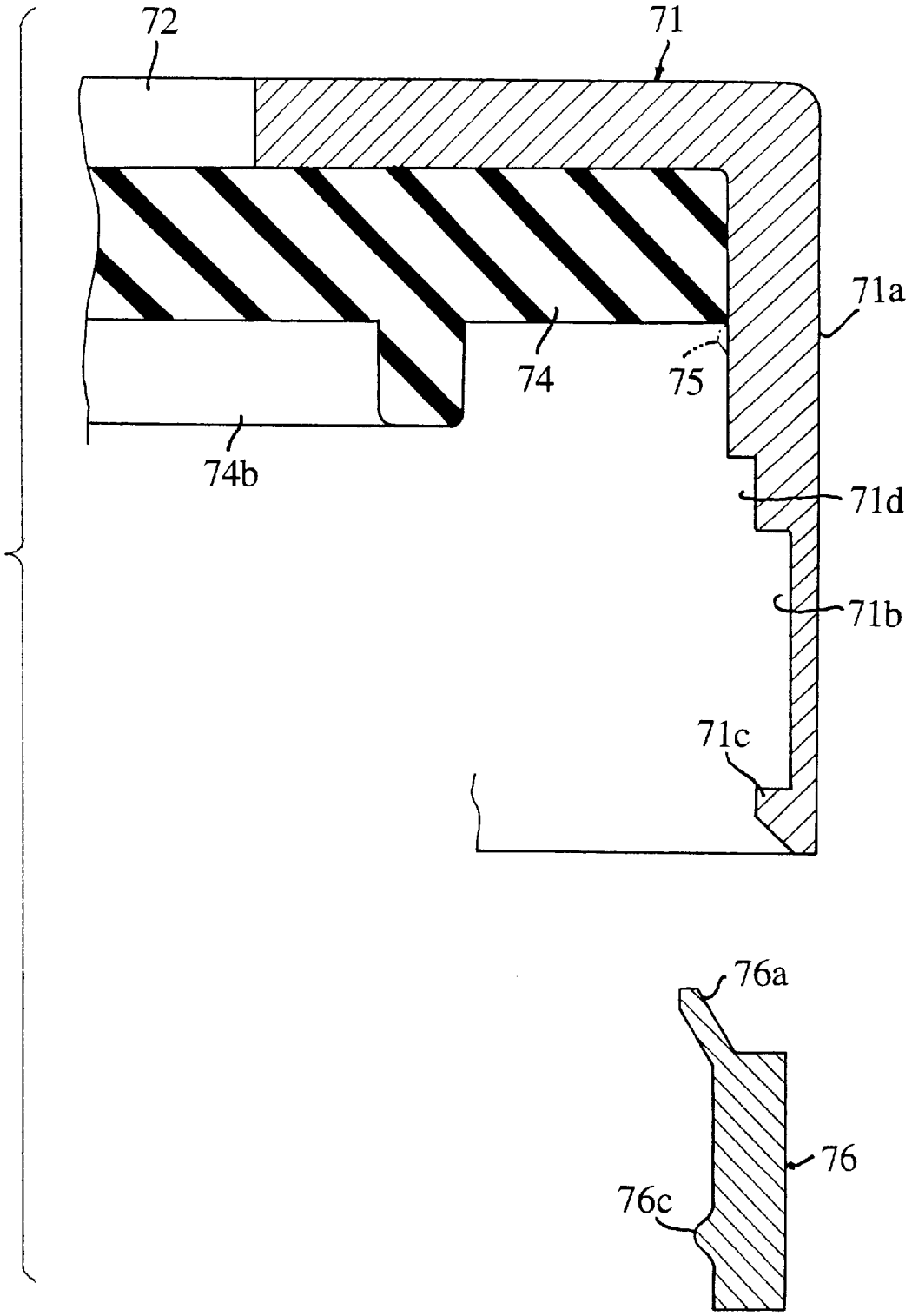
FIG. 15 is a sectional view of essential portions and shows the protector and the annular member of the embodiment (5).

The embodiment (5) of the present invention will be described in detail with reference to FIG. 15. In this embodiment, a protrusion or a low ridge 74*b* having a concentric ring-like structure is formed integrally on the lower surface of the sheet-like packing 74, and while this ridge 74*b* is fitted to, and supported by, the male mold (not shown) for molding the protector 71, the female mold (not shown) is so disposed as to oppose the male mold. The resin material is then fed between both molds, and the protector 71 into which the sheet-like packing 74 is inserted is molded.

It is the matter of production and assembly whether the sheet-like packing 74 is fitted after the protector 71 is molded or is inserted in advance into the protector 71. Therefore, interposing means of the sheet-like packing 74 may be either of them and is not particularly limited.

Effects of the Invention

The construction of the present invention described above can provide the following effects.

(a) The protector can be firmly kept in the semi-stopping freeze-drying posture and the full-stopping seal posture to the vial bottle by the simple construction, lift and come-off of the protector during transfer to the freeze-drying chamber can be completely prevented, and the processing efficiency can be improved.

(b) The shift of the protector having the bendable and flexible engaging plates, which engage with the upper surface of the bottle mouth, from the semi-stopping freeze-drying posture to the full-stopping seal posture can be effected smoothly, the full-stopping seal posture of the protector can be secured by a small push force, and breakage of the protector and the vial do not at all occur.

(c) If a person attempts to open outward the skirt end of the cylinder portion of the protector and to remove the stopper of the vial bottle, the moment which rotates the engaging plate downward acts as shown in FIGS. 7*c* and 12*c*, and release of the protector can be completely prevented, so that forgery of the drug can be completely prevented.

(d) Because the protector and the annular member are molded separately, the number of components increases but the economic effect is very great in comparison with integral molding because the mold of the protector can be drastically simplified.

(e) In addition to the effects described above, claim 5 can rationalize the semi-stopping freeze-drying posture by a simple construction.

(f) According to claim 1, the protector and the annular member are firmly supported, the annular member does not come off from the protector and the handling property of the protector can be improved, in addition to the effects described above.

(g) According to claim 6, the fitting and assembly work of the sheet-like packing can be eliminated and the working factor can be improved in addition to the effects described above.

What is claimed is:

1. In a unit closure for a vial container comprising a protector of synthetic resin provided at a top wall thereof with a window which is covered with a seal which can be pierced by a hypodermic needle, the protector having a cylindrical skirt engaged to the top wall which is provided at an inner surface thereof with air extractor passages adapted for communicating a vial container with the atmosphere, packing means fitted in the protector in contact with the top wall adapted for hermetically sealing a mouth of a vial container, and locking means provided on the inner surface of the skirt adapted for keeping the unit closure in a fixed air-expelling position on a vial container preparatory to a freeze-drying process and a hermetically sealed position on the container after the freeze drying process, wherein, the locking means comprises flexible locking tongues that are inclined diametrally inwardly of the cylindrical skirt and upwards towards the top wall of the protector adapted to snap resiliently into place underneath a flange of the mouth of a vial container and hold the unit closure firmly in the hermetically sealing position, wherein said locking tongues are formed as a unit with an annular member which has air-expelling passages, and the skirt of the protector is provided on the inner surface thereof with an annular concave groove to which the annular member is engaged, wherein the annular member is provided at a lower periphery thereof with ridge means formed as a unit with the annular member below the locking means adapted for keeping, in combination with the locking means, the unit closure in the air-expelling position on a vial container preparatory to a freeze-drying process.

2. The improvement according to claim 1, wherein the packaging means is inserted in a mold simultaneously with molding of the protector.

* * * * *